US005603117A

United States Patent [19]

Hudner, Jr. et al.

[11] Patent Number: 5,603,117

[45] Date of Patent: Feb. 18, 1997

[54] PROTECTIVE HELMET ASSEMBLY

[75] Inventors: Philip B. Hudner, Jr., Franklin; Mathew M. Correa, Ashland, both of Mass.

[73] Assignee: The United States of America as represented by the Secretary of the Army, Washington, D.C.

[21] Appl. No.: 528,630

[22] Filed: Sep. 13, 1995

[51] Int. Cl.[6] ..... A42B 3/00

[52] U.S. Cl. ..... 2/6.6; 2/423; 2/424

[58] Field of Search ..... 2/6.1, 6.2, 6.6, 2/6.7, 410, 411, 414, 416, 417, 422, 423, 424

[56] References Cited

U.S. PATENT DOCUMENTS

| | | | |
|---|---|---|---|
| 3,180,333 | 4/1965 | Lewis | 128/141 |
| 3,409,909 | 11/1968 | Scott et al. | 2/14 |
| 4,023,209 | 5/1977 | Frieder, Jr. et al. | 2/16 |
| 4,453,277 | 6/1984 | Durand et al. | 2/416 |
| 4,778,638 | 10/1988 | White | 264/152 |
| 4,843,642 | 7/1989 | Brower | 2/6 |
| 4,908,877 | 3/1990 | White | 2/6 |
| 5,056,162 | 10/1991 | Tirums | 2/412 |
| 5,075,904 | 12/1991 | Shirasaki et al. | 2/412 |

*Primary Examiner*—Michael A. Neas
*Attorney, Agent, or Firm*—Vincent J. Ranucci

[57] ABSTRACT

A protective helmet assembly to be worn on the head of a person includes a protective shell and a removable, adjustable suspension system mounted on the inner surface of the shell. The suspension system includes an impact liner mounted on the inner surface of the protective shell, a plurality of sizing pads removably mounted on the impact liner, and a plurality of spare sizing pads. The plurality of sizing pads and spare sizing pads are sized and shaped of varying thickness so as to enable the protective helmet assembly to accommodate a broad range of head sizes and shapes. The protective helmet assembly further includes a pair of earcups pivotally mounted on opposite sides of the shell. Each of the earcups are pivotally adjustable by a pair of ratchet buckles mounted on the protective shell, and a pair of retainer straps. Each retainer strap is attached to the outer surface of one of the earcups and to one of the ratchet buckles. When each retainer strap is tightened by stepwise adjusting the retainer strap through one of the ratchet buckles, the retainer strap pulls the earcup pivotally inward creating a tight pressure seal around the ear of the head of the person. The protective helmet assembly additionally includes a vertical strut mounted on both the front/left side and front/right side of the protective shell, each vertical strut including a hooked-shaped slot, and a facemask having a left end and a right end. The facemask includes a pair of pins, one mounted on the left end and one mounted on the right end, each pin being pivotally mountable in one of the hooked-shaped slots.

5 Claims, 7 Drawing Sheets

Fig. 5
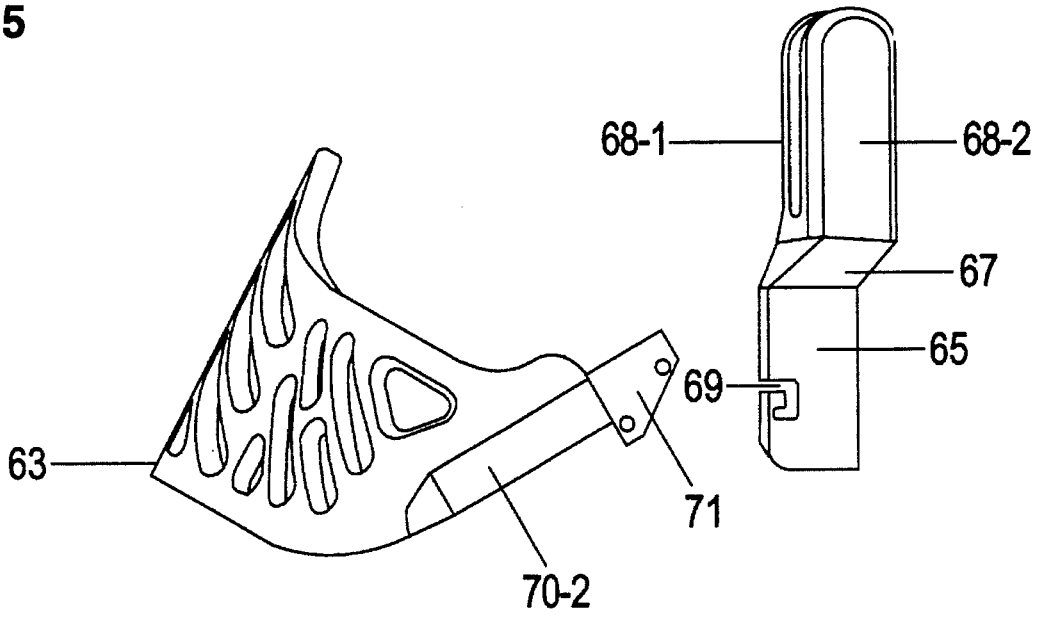
Fig. 6
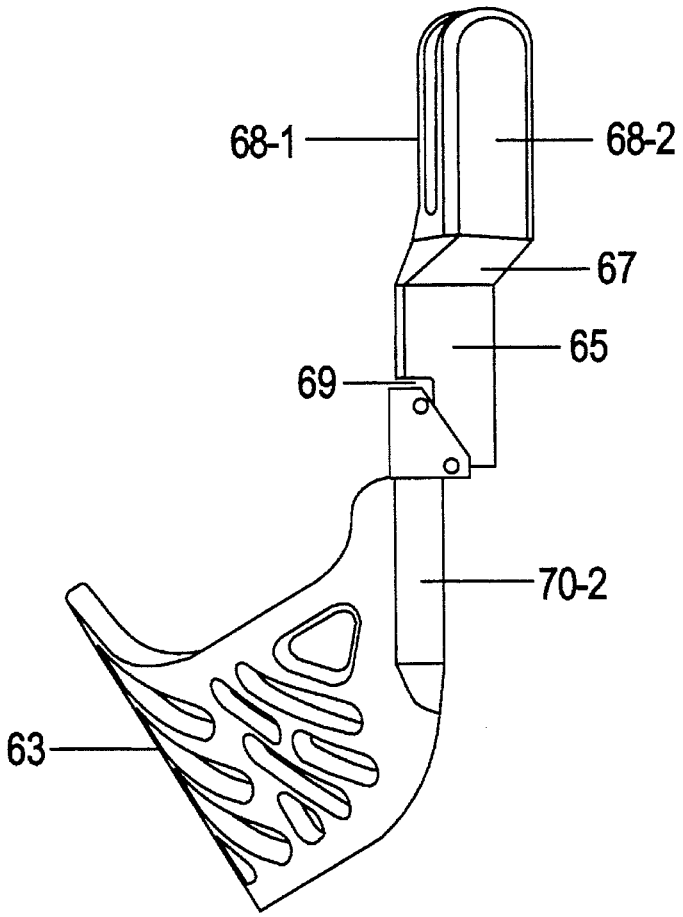
FIG. 5, 6

PROTECTIVE HELMET ASSEMBLY

STATEMENT OF GOVERNMENT INTEREST

The invention described herein may be manufactured, used and licensed by or for the Government for Governmental purposes without the payment to me of any royalty thereon.

BACKGROUND OF THE INVENTION

The present invention relates generally to protective helmets, and more specifically to a combat vehicle crewman (CVC) helmet assembly which provides ballistic, aural, head, and facial protection.

The provision of a helmet assembly which will comfortably fit combat crewman (CVC) while providing the requisite ballistic, aural, head, and facial protection as well as acoustic attenuation has presented a problem of long standing in the art. Such a helmet assembly should afford the wearer with a larger measure of ballistic protection, protection from injury resulting from contact with surfaces within the vehicle and it should limit the noise from within the vehicle which reaches the wearer's ear to a level which will not interfere with communication or damage hearing. All of the foregoing must be accomplished in headgear which is not unduly heavy, which may be adjusted to fit various size heads, which will not interfere with the required activities of the wearer and which may be worn with relative comfort for long periods of time. There has not previously been a helmet which would meet all these requirements.

In U.S. Pat. No. 4,023,209 to Frieder, Jr. et al, which issued May 17, 1977, there is disclosed a protective helmet assembly which includes a flexible inner helmet designed to fit relatively closely over a wearer's head and fitted with one or more impact-absorbing pads, and a hard rigid ballistic outer shell comprising a frontal portion releasably secured over the forehead area of the inner helmet and a rear portion releasably secured over the crown-to-nape area of the inner helmet, and in which assembly the inner helmet is provided with a pad of relatively flexible ballistic material in the forehead region thereof below the frontal portion of the outer shell.

It should be noted that the above-described protective helmet assembly has certain drawbacks. For instance, the aforementioned protective helmet assembly includes only a removable inner helmet; the inner helmet is not adjustable, thereby precluding such an assembly from accommodating a broad range of head sizes.

It is also very common in the prior art for protective helmet assemblies to use chinstraps to retain the earcups and provide earcup pressure to the head. Traditionally, the chinstrap is attached to the earcup to the wearer's head. Alternative methods for applying earcup pressure to the wearer's head, independent of a chinstrap, have been limited. One example of a protective helmet which applies earcup pressure without the use of a chinstrap is U.S. Pat. No. 4,453,277 to Durand et al. This patent discloses a helmet suitable for use by combat vehicle crewman comprising a rigid shell, formed of a ballistic resistant material, having earcup receiving extensions affixed thereto. Earcups are mounted in the shell extensions and are capable of movement in two directions thereto. The helmet also has an internal suspension system which affords two additional size adjustments.

It should be noted that the above-described protective helmet issued to Durand et al. has certain drawbacks. For example, the protective helmet offers no facial protection.

Additionally, the aforementioned protective helmet has a cradle suspension system constructed of nylon straps.

Other patents of interest include U.S. Pat. No. 5.075,904 to Shirasaki et al, U.S. Pat. No. 5.056,162 to Tirums, U.S. Pat. No 4,908,877 to White, U.S. Pat. No. 4,843,642 to Brower, U.S. Pat. No. 4,778,638 to White, U.S. Pat. No. 3,409,909 to Scott et al, and U.S. Pat. No. 3,180,333 to Lewis.

SUMMARY OF THE INVENTION

It is an object of the present invention to provide a new and improved protective helmet assembly.

It is another object of the present invention to provide a protective helmet assembly which will offer ballistic, aural, head, and facial protection.

It is yet another object of the present invention to provide a protective helmet assembly which includes a suspension system capable of accommodating a broad range of head sizes and shapes.

It is still another object of the present invention to provide a protective helmet assembly which improves the fit of the earcup around the wearer's ear, thereby enhancing the sound attenuation, independent of the fastening of a chin strap.

It is even another object of the present invention to provide a protective helmet assembly which includes a simple means of attachment and removal for a faceguard.

It is yet another object of the present invention to provide a protective helmet assembly having an overall configuration which is modified to fit the Army population of today.

It is still another object of the present invention to provide a protective helmet assembly which dissipates heat through increased levels of ventilation within the protective helmet assembly.

In furtherance of the objects broadly set forth above, a protective helmet assembly to be worn on a person's head is provided which comprises a protective shell having an inner surface, an outer surface, a left side, a right side, a front and a rear, and adjustable suspension means mounted on the inner surface of said shell for accommodating said helmet assembly to conform to a broad range of head sizes.

According to another feature of the present invention, the protective helmet assembly further comprises a pair of earcups, one pivotally mounted on the left side of said shell and the other earcup being pivotally mounted on the right side of said shell, and means for pivotally adjusting the position of each said earcups relative to the head of a person.

According to yet another feature of the present invention, the protective helmet assembly further comprises a pair of vertical struts, one strut being mounted on the front, left side of said protective shell and the other strut being mounted on the front, right side of said protective shell, a facemask having a left end and a right end, and means for mounting the left and right ends of said facemask to said vertical struts.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts:

FIG. 5 is a left perspective view of the vertical strut and facemask of FIG. 1, the facemask not being attached to the strut;

FIG. 6 is left perspective view of the vertical strut and facemask of FIG. 5, the facemask being attached to the strut;

DETAILED DESCRIPTION OF A PREFERRED EMBODIMENT

Figure 1:
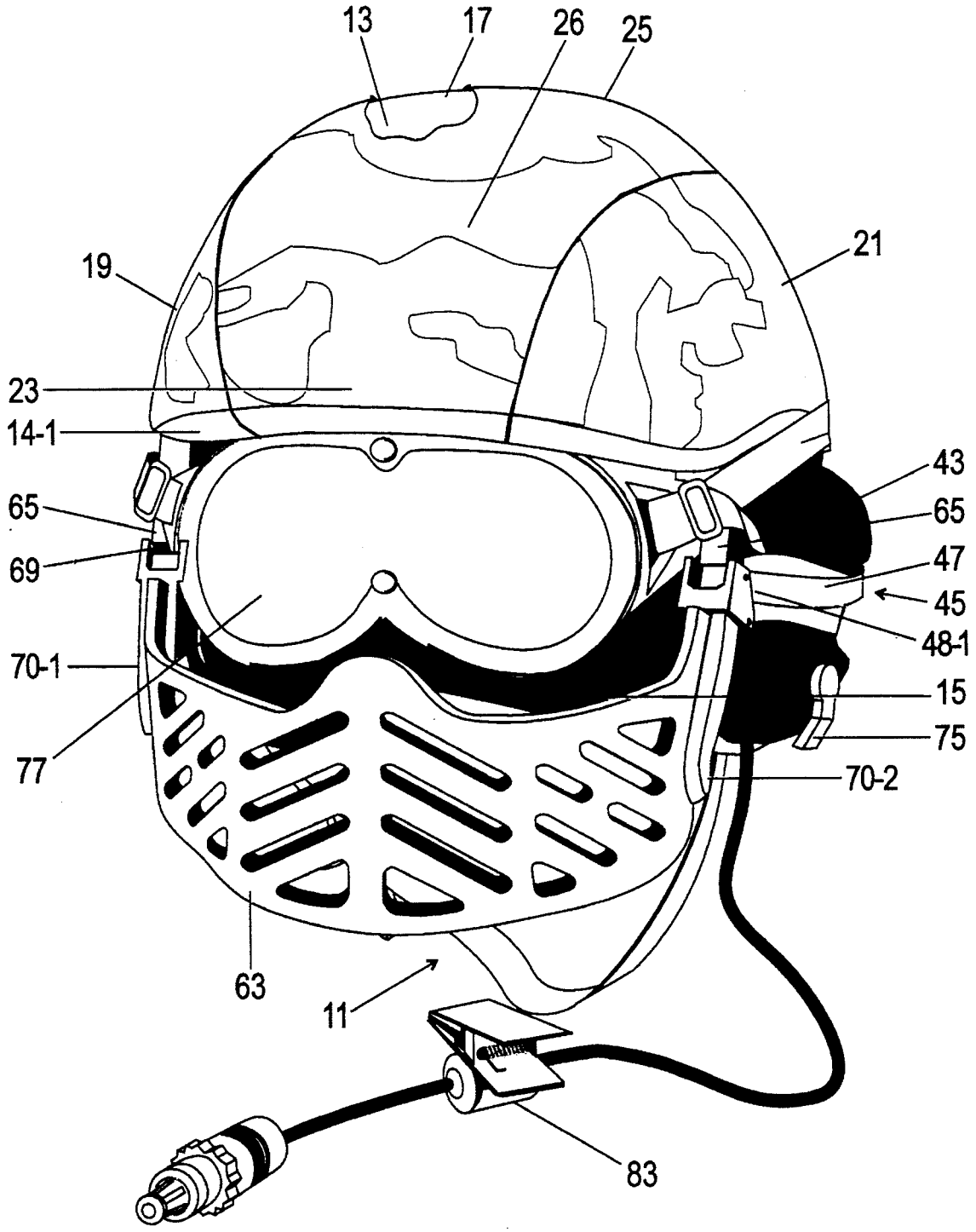
FIG. 1 is top, front perspective view, broken away in part, of a protective helmet assembly constructed according to the teachings of the present invention.

Referring now to the drawings and more particularly to FIG. 1, there is a shown a top, front perspective view, broken away in part, of a protective helmet assembly constructed according to the teachings of the present invention, the protective helmet assembly being represented generally by reference numeral 11. Those aspects of system 11 not pertinent to the present invention are neither described nor shown herein.

Figure 7:
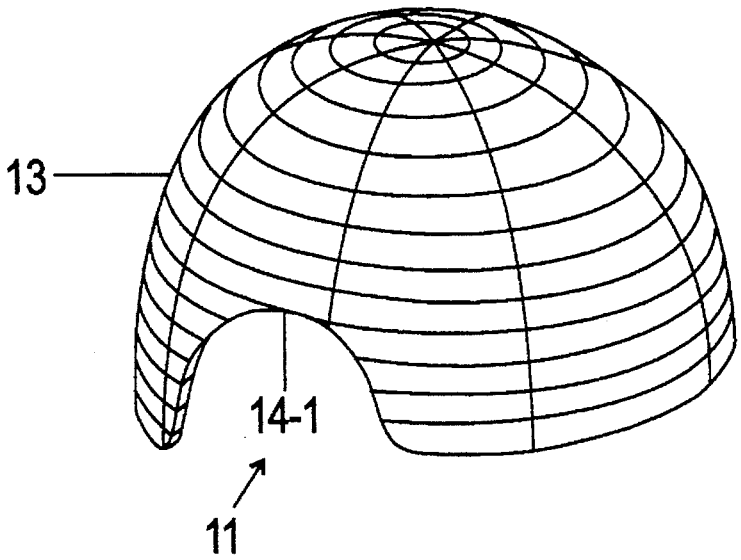
FIG. 7 is a top, right side perspective view of the shell of the protective helmet assembly of FIG. 1.
Figure 8:
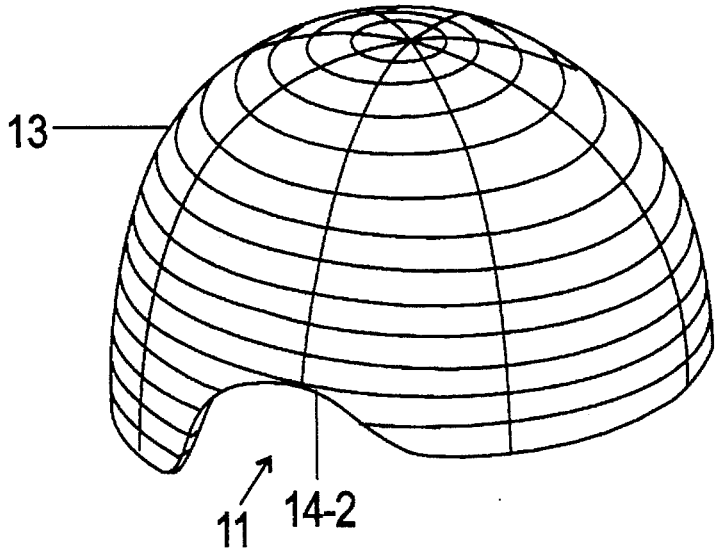
FIG. 8 is a top right side perspective view of the shell of prior art protective helmet assemblies.
Figure 9:
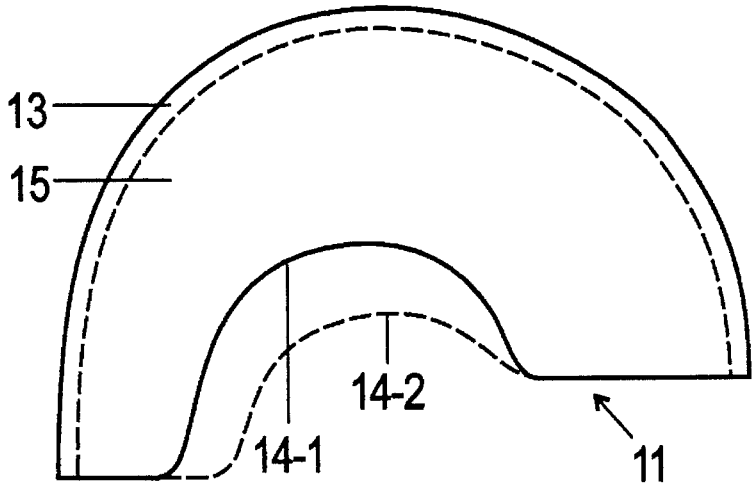
FIG. 9 is a combined section view of the shells of FIG. 8 and FIG. 9.

Protective helmet assembly 11 includes a protective shell 13 having an inner surface 15, an outer surface 17, a right side 19, a left side 21, a front 23 and a rear 25. Protective shell 13 is compression molded from a material characterized by light weight and exceptional resistance to penetration by objects impacting thereon, shell 13 is constructed of, but not limited exclusively to, a material known as "KEVLAR" KM-2, 850 Denier. Referring to FIGS. 7, 8, and 9, shell 13 of protective helmet assembly 11 has novel dimensions compared to shell 13 of prior art protective helmet assemblies. Referring specifically to FIG. 9, shell 13 of the present embodiment comprises the dimensions which more accurately fit the Army population of today, including the proper distance from the tragion to the top of the head. Numerically, in the present embodiment, the distance from lower periphery 14-1 of left side 19 of shell 13 to the top of shell 13 has been decreased from the prior art distance of lower periphery 14-2 of left side 19 of shell 13 the top of shell 13. The change in dimensions of the present embodiment has effectively reduced surface area of the prior art by 11 inches$^2$, or 6.25%. Additionally, protective helmet assembly 11 includes a removable camouflage cover 26 which fits securely over shell 13.

Referring now to FIGS. 2, 2A, 2B and 2C, there is shown mounted on inner surface 15 of shell 13 a removable, adjustable suspension means 27. Suspension means 27 enables protective helmet assembly 11 to conform to a broad range of head sizes, adjustable suspension means 27 is comprised of an impact liner 29 and a plurality of sizing pads 31. Impact liner 29 is mounted to inner surface 15 of shell 13 by hook and pile strip fasteners (not shown). Impact liner 29 is of a spider-shaped configuration so as to encompass a large area of inner surface 15 and to allow for increased levels of air flow within helmet assembly 11. Impact liner 29 is constructed of, but not exclusively limited to, a material known as "PLASTAZOTE" HD 80, which is a high density, closed cell foam.

Figure 2:
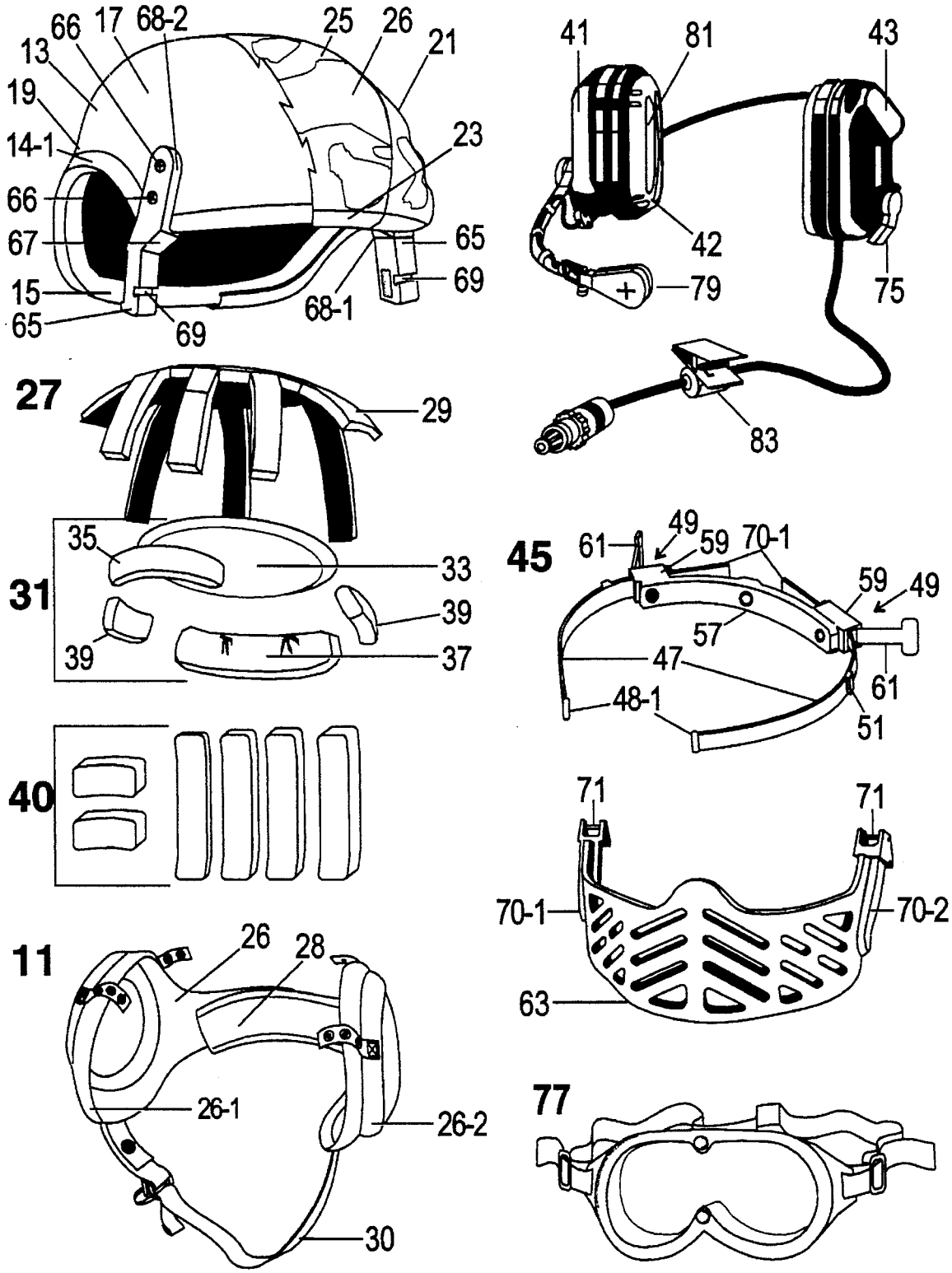
FIG. 2 is an assembly drawing of the component parts of the protective helmet assembly of FIG. 1.
Figure 2C:
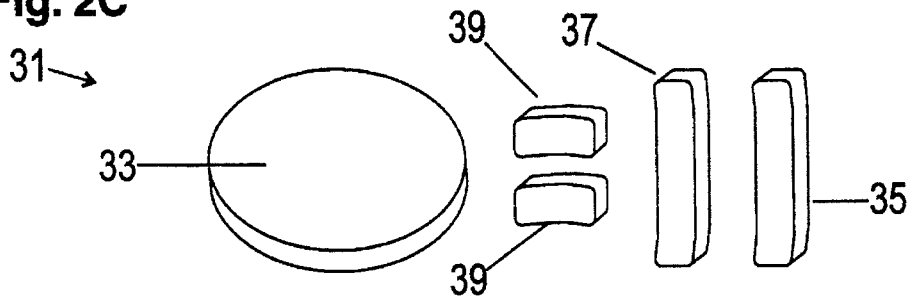
FIG. 2C is a pictorial view of the sizing pads in the protective helmet assembly of FIG. 2.
Figure 2B:
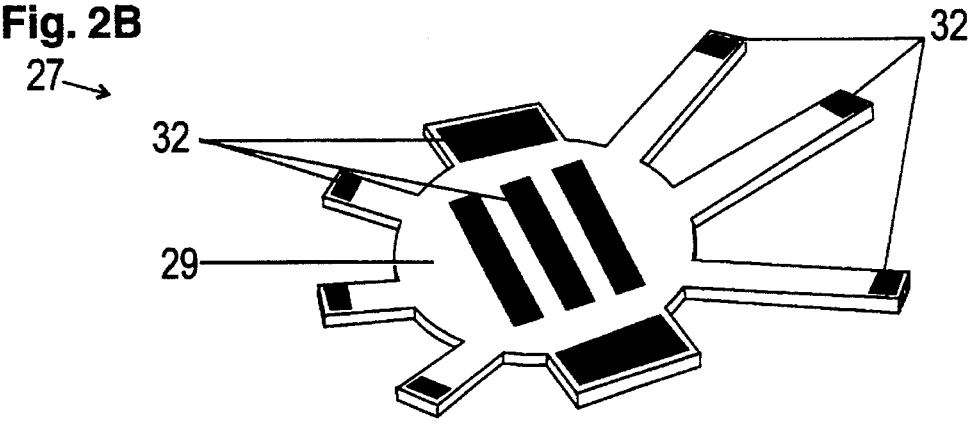
FIG. 2B is a pictorial view of the impact liner in the protective helmet assembly of FIG. 2 with hook and pile tabs attached thereto.
Figure 2A:
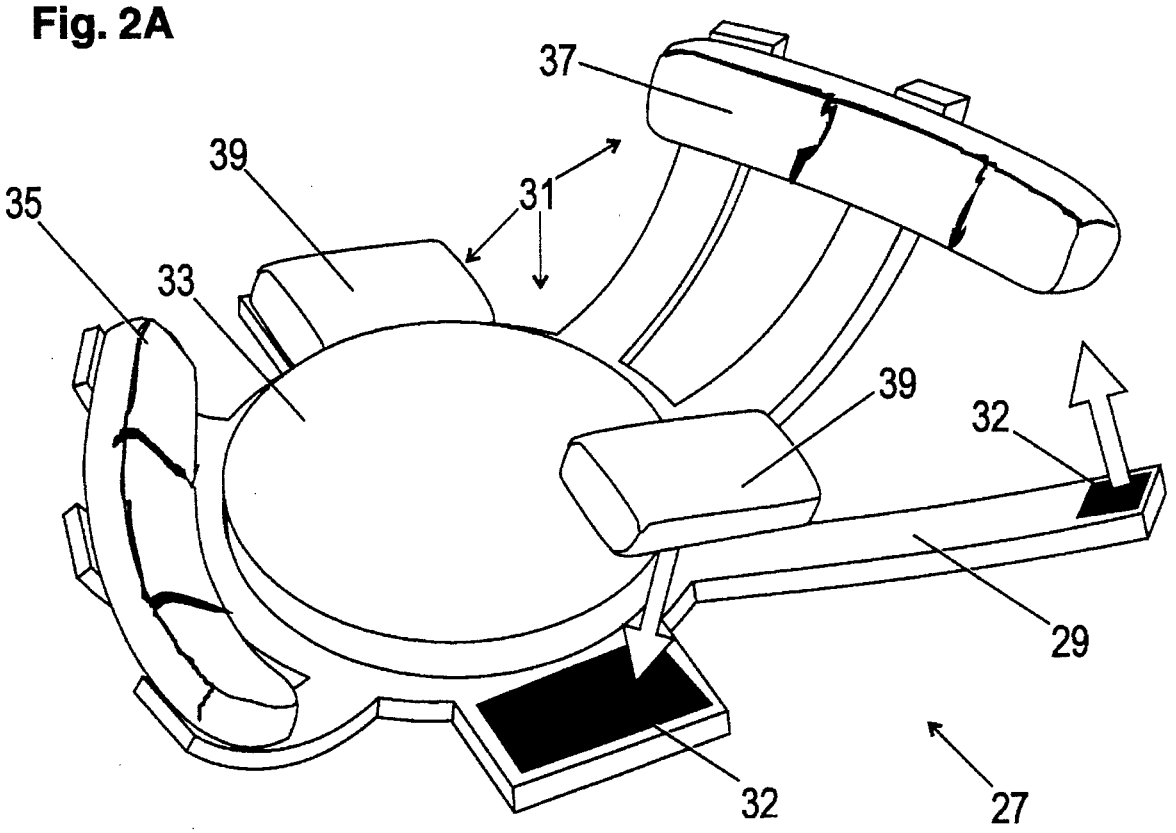
FIG. 2A is a pictorial view of the adjustable suspension means in the protective helmet assembly of FIG. 2.

Sizing pads 31 are removably mounted to impact liner 29 by hook and pile strip fasteners 32. Sizing pads 31 include one crown sizing pad 33, one front sizing pad 35, one rear sizing pad 37, and a pair of side sizing pads 39. Suspension means 27 further includes a plurality of spare pads 40 which can be used in substitution of front sizing pad 35, rear sizing pad 37, and side sizing pads 39. Spare pads 40 are constructed of varying thicknesses which can be utilized in accordance with sizing pads 39 to adjust the shape of the inside of helmet assembly 11, thereby enabling helmet assembly 11 to accommodate a multiplicity of different sized heads. Sizing pads 31 are constructed of, but not limited exclusively to, a lower density foam material, such as "PLASTAZOTE" LD 45, this foam being covered by leather to maximize comfort. To further maximize comfort, the configuration of impact liner 29 and sizing pads 31, as shown in FIG. 2A, serves to increase the overall ventilation and circulation of air within protective helmet assembly 11.

Protective helmet assembly 11 also includes a retention assembly 26 which is bolted onto shell 13. Retention assembly 26 includes left and right earcup housing retainers 26-1, 26-2, which are aligned along the inverted U-shaped openings in right and left sides 19, 21, respectively, of lower periphery 14-1 of shell 11. Each earcup housing retainer 26-1, 26-2 defines a generally oval-shaped opening. Inner liner 26 further includes a nape strap 28 and chin strap 30 both of which help secure helmet assembly 11 to the head of the user.

Protective helmet assembly 11 further comprises left and right earcups 41, 43. Referring to FIG. 2, left and right earcups 41, 43 are mounted within the generally oval-shaped openings of left and right earcup housing retainers 26-1, 26-2, respectively. Each of earcups 41, 43 are anatomically designed to contour the shape of the ear, and comprise an earseal 42 mounted on the inner surface of earcups 41, 43. Earseal 42 is filled with silicone to maximize comfort and to create a tight seal between earcups 41, 43 and the ear of the person.

Figure 3:
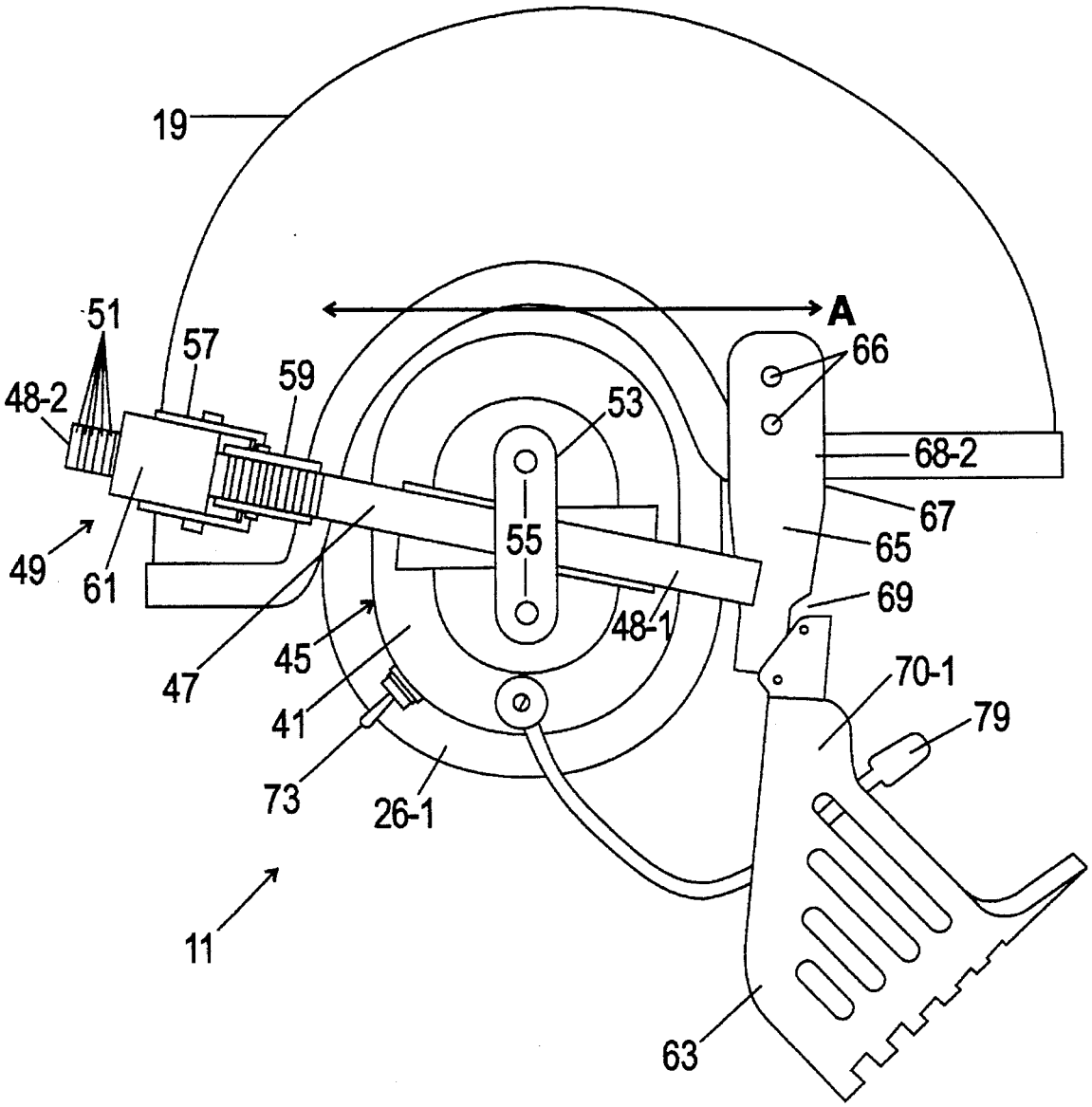
FIG. 3 is a right side view of the protective helmet assembly of FIG. 1, the protective goggles not being shown.

Protective helmet assembly 11 further comprises means 45 for pivotally adjusting the position of earcups 41, 43 along a hinge axis A, as shown in FIG. 3. FIG. 3 shows a right side view of protective helmet assembly 11, the details of the left side 21 of helmet assembly 11 being an exact reflection of the right side 19 of helmet assembly 11; therefore, due to the mirror-like image of left side 21 to right side 19, the details of right side 19 will be described in full detail and the details of left side 21 can be referred through the description of right side 19.

Pivot means 45 comprises a retainer strap 47 affixed to earcup 41 and a ratchet buckle 49 which secures the desired tension of retainer strap 47. Retainer strap 47, constructed of plastic or other suitable material, is generally rectangular in shape and has a front end 48-1 and a rear end 48-2. Additionally, retainer strap 47 has a plurality of ratchet groves 51 integrally formed on a portion of strap 47 in close proximity to rear end 48-2. Front end 48-1 is affixed to a vertical strut (to be discussed later in detail) and rear end 48-2 is secured to helmet assembly 11 by ratchet buckle 49. A portion of strap 47 located between ends 48-1, 48-2 is affixed to the outer surface of earcup 41, in this embodiment by a metallic member 53 which is secured to earcup 41 over strap 47 be screws 55. The increase or decrease of tension in strap 47 causes earcup 41 to pivot inward or outward, respectively, along hinge axis A.

Figure 4:
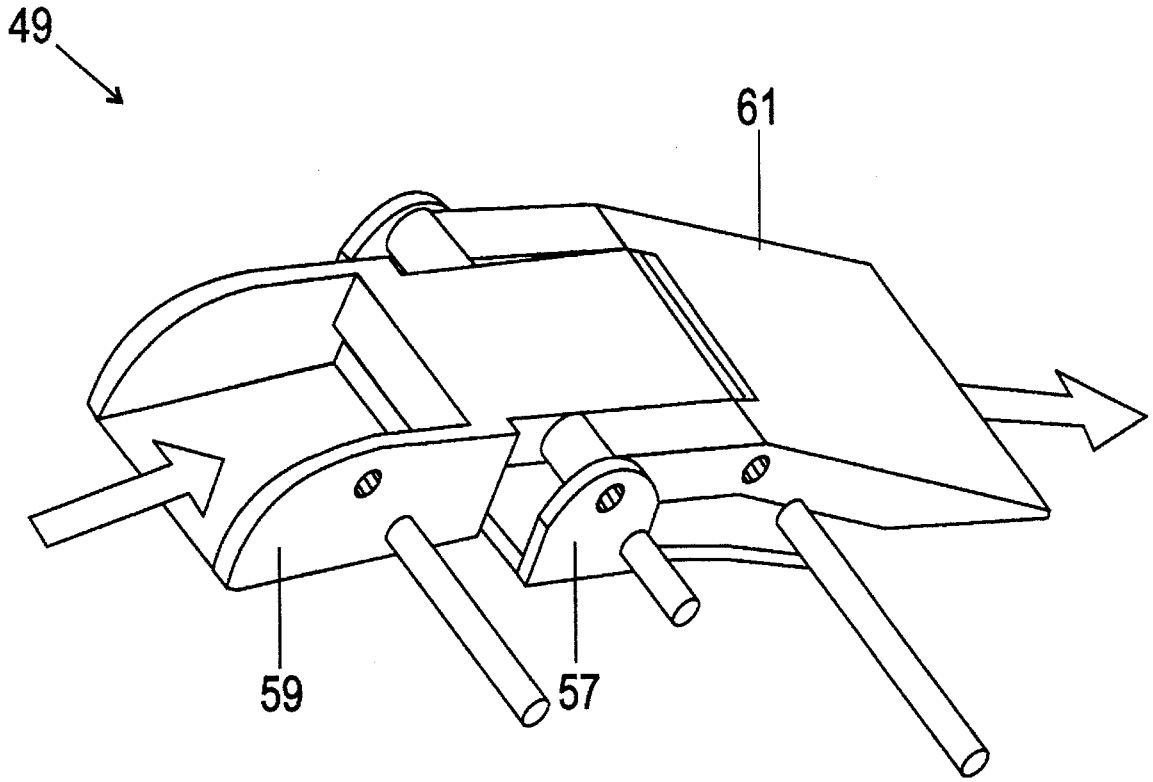
FIG. 4 is a top, rear perspective view of the ratchet buckle shown in FIG. 3.

Referring to FIGS. 3 and 4, ratchet buckle 49 comprises a mounting bracket 57, a hasp 59, and a latch 61. Mounting bracket 57 is mounted along rear 25 of shell 13 from left side 19 to right side 21 as one piece (whereas all the other components of pivot means 45 are broken up into a left side piece and a right side piece). Mounting bracket 57 serves as the foundation of ratchet buckle 49 and as the means of attaching ratchet buckle 49 to shell 13. Hasp 59 is affixed to mounting bracket 57 and serves as a means for guiding strap 47 through ratchet buckle 49. Latch 61 is also mounted on mounting bracket 57 and serves to lock the position of strap 47 in a desired position. Latch 61 engages with the plurality of ratchet grooves 51 to lock strap 47 at its desired tension.

Referring to FIGS. 1–3, 5 and 6, protective helmet assembly 11 further comprises a facemask 63 and a pair of vertical struts 65. Each vertical strut 65 includes a forked end 67 and a hooked-shaped slot 69 integrally formed on the opposite end of forked end 67. Forked end 67 includes an inner elongated prong 68-1 and an outer elongated prong 68-2. Inner elongated prong 68-1 is affixed to inner surface 15 of shell 13 and outer prong 68-2 is affixed to outer surface 17 of shell 13 by one or more bolts 66. Vertical struts 65 are mounted to shell 13 in a downward position from opposite sides of front 23 of shell 13, along lower periphery 14-1 of shell 13. ends 70-1, 70-2, there is a mounted pin 71. Pin 71 is pivotally mountable onto hook-shaped slot 69. Pins 71 engage with hooked-shaped slots 69 to enable facemask 63 to be mounted onto vertical struts 65 of helmet assembly 11 (as shown in FIG. 6), or removed from vertical struts 65 of helmet assembly 11 (as shown in FIG. 5).

Protective helmet assembly 11 further includes a radio push-to-talk switch 75, a talk-through activator 73, a pair of protective goggles 77, a microphone 79, a pair of earphones 81, and a clip 83. Radio push-to-talk switch 75, located on left earcup 43, is responsible for activating radio communication. Talk-through activator 73, located on right earcup 41, enables the user to listen to sounds in the user's immediate environment without having to remove earcups 41, 43. Protective goggles 77 are mountable over shell 13 of helmet assembly 11 in such a position that goggles 77 are situated in between facemask 63 and front 23 of shell 13, directly below lower periphery 14-1 of shell 13. Microphone 79 is attachable to one of earcups 41, 43 and can be positioned near the user's mouth. Earphones 81 are mounted within each of earcups 41, 43, in connection with switch 73, activator 75 and microphone 79. Clip 83, which is affixed to the radio connection wire, enables the user to secure the wire to an object.

To place protective helmet assembly 11 on the head of a user, the following steps may be taken: First facemask 63 and protective goggles 77 are removed from helmet assembly 11. Then latch 61 of ratchet buckles 49 are unlocked, thereby loosening the tension of straps 47. Additionally, nape strap 28 and chin strap 30 of inner liner 26 are disconnected. Next, helmet assembly 11 is placed on the user's head. Then latch 61 of ratchet buckles 49 are locked back into position. Rear ends 48-2 of straps 47 are then pulled tautly, thereby tightening the tension of straps 47 and drawing earcups 41, 43 tightly around the ears of the wearer. Earcups 41, 43 can be further tightened around the ears of the wearer by fastening tautly nape strap 28 and chin strap 30 of inner liner 26.

Facemask 63 is then attached to helmet assembly 11 by placing pins 71 into pivoting snap connection with hooked-shaped slots 69 of vertical struts 65. Protective goggles 77 are then mounted over shell 13 of helmet assembly in such a position that goggles 77 are situated in between facemask 63 and front 23 of shell 13, directly below periphery 14-1 of shell 13. Lastly, microphone 79 is positioned directly in front of the user's mouth. Radio communication can then be activated by radio push-to-talk switch 75, located on left earcup 43. Also, the user can listen to sounds in the user's immediate environment without having to remove earcups 41 by activating talk-through activator 73, located on right earcup 41. To remove helmet assembly 11, one must release fastener clips 75, nape strap 28 and chin strap 30 and then gently slide assembly 11 off the user's head.

The embodiment of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A protective helmet assembly to be worn on a person's head, comprising:

a protective shell having an inner surface, an outer surface, a left side, a right side, a front and a rear;

adjustable suspension means mounted on the inner surface of said shell for accommodating said helmet assembly to conform to a broad range of head sizes, said adjustable suspension means having an impact liner mounted on the inner surface of said protective shell, a plurality of sizing pads mounted on said impact liner, and a plurality of spare sizing pads of varying thickness, said plurality of spare sizing pads which can be utilized in accordance with said plurality of sizing pads to adjust the shape of the inner surface of said helmet assembly thereby enabling said helmet assembly to accommodate a multiplicity of different sized heads;

a pair of earcups, one earcup being pivotally mounted on the left side of said shell, and one earcup being mounted on the right side of said shell;

means for pivotally adjusting the position of each of said earcups relative to the person's head, said pivotally adjusting means having a pair of ratchet buckles mounted on the rear, outer surface of said protective shell, and a pair of retainer straps, one strap being attached to each of said earcups and to each of said ratchet buckles, wherein when each of said retainer straps are tightened by stepwise adjusting the strap through one of each of said ratchet buckles, the straps causing each of said earcups to be pivotally displaced inward creating a pressure seal around the ears of the person's head;

a pair of vertical struts, one strut being mounted on the front, left side of said protective shell and the other strut being mounted on the front, right side of said protective shell;

a facemask having a left and a right end; and means for mounting the left and right ends of said facemask to said vertical struts.

2. The protective helmet assembly as recited in claim 1, wherein one end of each of said retainer straps is attached to each of said vertical struts and the other end of each of said retainer straps passes through each of said ratchets and the middle portion of said retainer strap is attached to each of said earcups.

3. The protective helmet assembly as recited in claim 2, further comprising:

a camouflage cover mounted over the outside surface of said protective shell; and an inner liner bolted to said protective shell, said inner liner having a nape strap, a chin strap, and a pair of earcup housing retainers, each of the earcup housing retainers having a circular opening in its center, wherein each of said earcups is mounted within each of the openings in the earcup retainers.

4. The protective helmet assembly as recited in claim 3 further comprising a microphone, an earphone mounted within each of said earcups, a radio push-to-talk switch, and talk-through activator, all in connection operatively with one another.

5. A protective helmet assembly to be worn on a person's head, comprising:

a protective shell having an inner surface, an outer surface, a left side, a right side, a front and a rear;

adjustable suspension means mounted on the inner surface of said shell for accommodating said helmet assembly to conform to a broad range of head sizes;

a pair of earcups, one earcup being pivotally mounted on the left side of said shell, and one earcup being mounted on the right side of said shell;

means for pivotally adjusting the position of each of said earcups relative to the person's head;

a pair of vertical struts, one strut being mounted on the front, left side of said protective shell and the other strut being mounted on the front, right side of said protective shell, each of said vertical struts having a hook-shaped slot;

a facemask having a left end and a right end; and a pair of pins, one pin being mounted on the left end of said facemask and the other pin being mounted on the right end of said facemask, said pins being pivotally mountable onto each of the hooked-shaped slots on said vertical struts.

* * * * *